United States Patent [19]

Sharp

[11] 4,372,422

[45] Feb. 8, 1983

[54] ESCAPE DEVICE

[76] Inventor: Thurman V. Sharp, 1813 Sanford Apt. 2, Little Rock, Ark. 72202

[21] Appl. No.: 220,966

[22] Filed: Dec. 29, 1980

[51] Int. Cl.[3] ..... A62B 1/16; A62B 35/00

[52] U.S. Cl. ..... 182/5; 188/65.4

[58] Field of Search ..... 182/3-7; 188/65.1-65.5; 24/115 H, 68 F, 68 R, 68 E; 254/394, 371

[56] References Cited

U.S. PATENT DOCUMENTS

| | | | |
|---|---|---|---|
| 191,886 | 6/1877 | Roch et al. | 182/5 |
| 340,573 | 4/1886 | Hamlin et al. | 182/7 |
| 411,165 | 9/1889 | Noack | 254/394 |
| 573,739 | 12/1896 | Wethered | 182/7 |
| 586,173 | 7/1897 | Frahm | 182/6 |
| 642,889 | 2/1900 | Whitner | 182/5 |
| 689,850 | 12/1901 | Bustin | 182/5 |
| 725,251 | 4/1903 | Holson | 182/5 |
| 769,998 | 9/1904 | Foote | 254/394 |
| 770,012 | 9/1904 | Kramer | 182/6 |
| 1,351,734 | 9/1920 | Barrington | 182/5 |
| 2,976,955 | 3/1961 | Huber | 188/65.1 |
| 3,115,216 | 12/1963 | Sandnes | 188/65.2 |
| 3,739,875 | 6/1973 | Padwicki | 182/6 |
| 3,948,362 | 4/1976 | Greest | 182/5 |

*Primary Examiner*—Reinaldo P. Machado

*Attorney, Agent, or Firm*—Bernard, Rothwell & Brown

[57] ABSTRACT

A device for escaping from elevated locations, particularly in an emergency, is provided. The device controls the travel of a weight, e.g., a human passenger, on an essentially 1:1 ratio of rope or cable length to the distance of travel. The invention can be employed for either vertical or horizontal travel. Further, this invention can be operated by a passenger or from a lower location such as the ground or any other place towards which the weight is to travel. The device contains at least one roller, preferably a plurality, around which the cable or rope is run. The roller is generally tapered from at least one side towards a middle location and grooved at the latter to facilitate proper operation, good braking ability, low heat generation during operation and braking, and easy release from a stationary position.

20 Claims, 7 Drawing Figures

FIG. 1
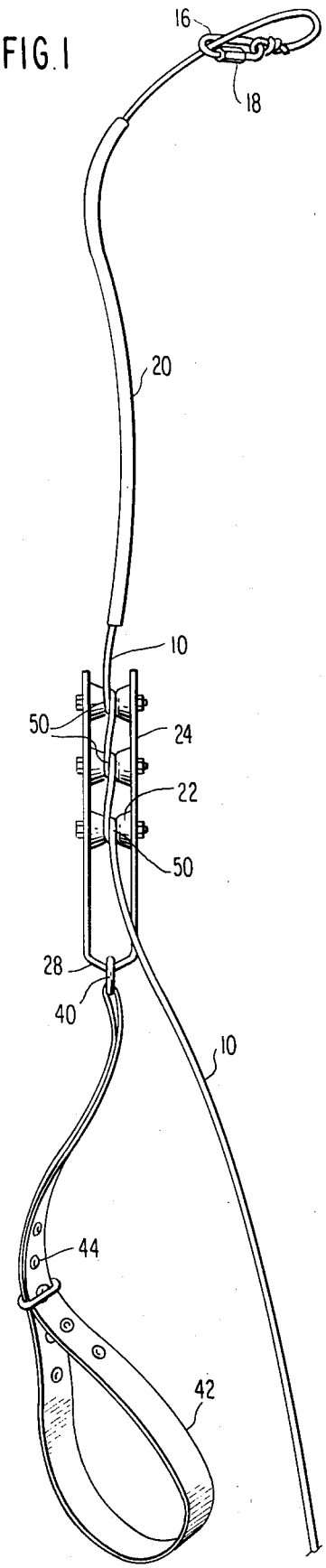
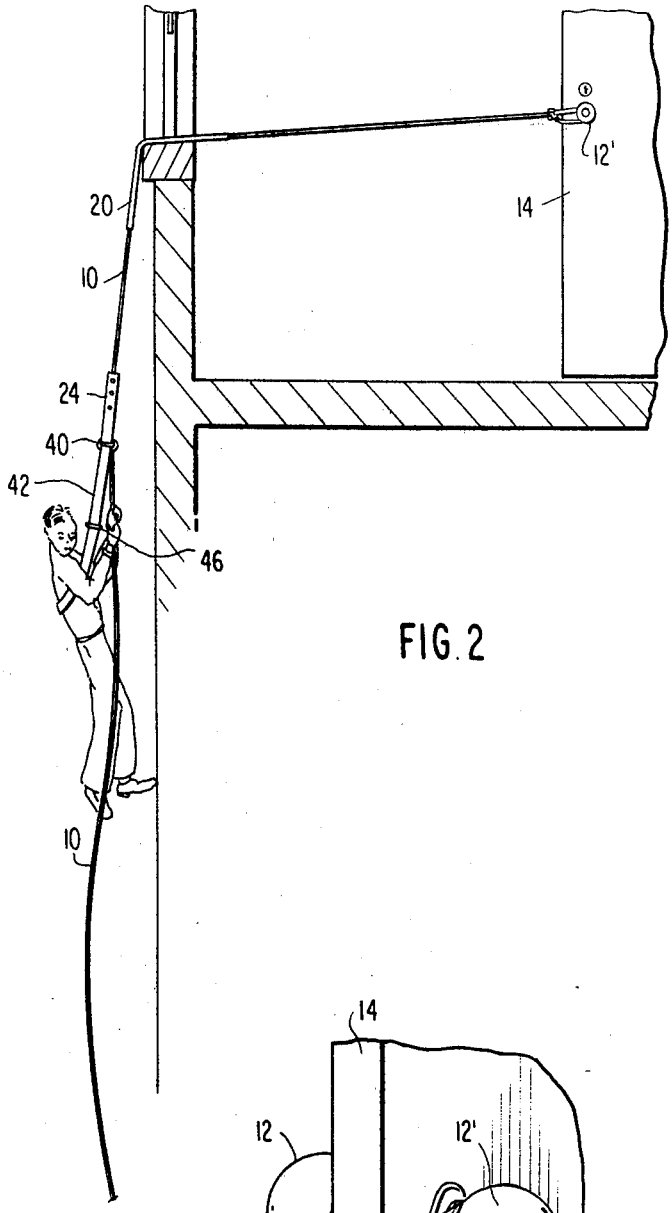
FIG. 2
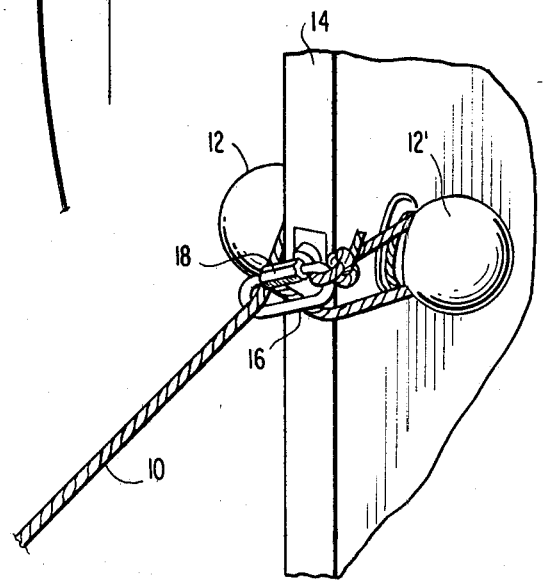
FIG. 3

FIG. 4
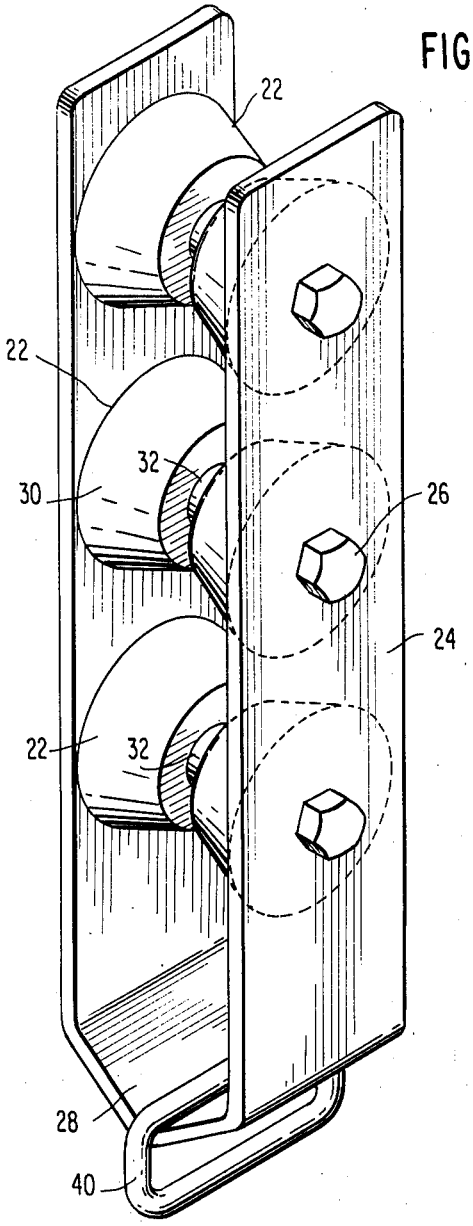
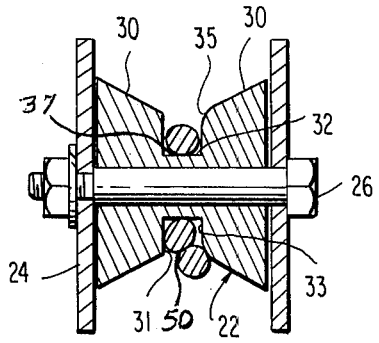
FIG. 5
FIG. 6
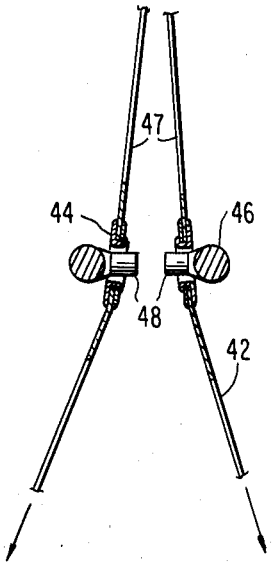
FIG. 7
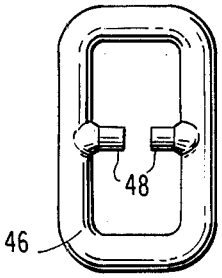

ESCAPE DEVICE

The present invention relates to escape devices, and is particularly concerned with a system that is operated by a passenger on the device or another person which system allows slow descent or progress by the passenger or other weight along a line secured to an upper support such as a building, drilling oil rig, tower or the like. The device is particularly advantageous in that the amount of rope or cable is essentially the minimum required to reach a desired lower location from the upper support, yet the operator has a material mechanical advantage which makes it possible to move and control the device with the exertion of considerably less holding force than would otherwise be required.

There have been many prior proposals for devices of a more or less portable type which serve to facilitate the lowering of people or cargo from an elevated location. The devices may involve a system of pulleys that are designed to have a mechanical advantage so that the load can be lowered and controlled without exertion of force of a magnitude equal to the weight of the load. Such systems can become quite bulky and impractical as a portable device suitable for a person to carry inconspicuously. Aside from involving the use of multiple pulleys, the devices may need a considerably greater amount of line than the height from which the load is to be lowered or moved horizontally, if the latter be needed.

Other known devices may permit the load to travel along a single strand of rope or cable, but in the simplest form one must use virtually the same amount of force to stop or even control the device during its descent. Consequently, there have been provided a variety of means for mechanically stopping or controlling these devices and frequently these modifications enlarge the size of the equipment and make it more complicated and expensive. As a result the devices may become impractical as a portable system, at least not one that a person could easily carry in luggage or by other inconspicuous means for ready use should the occasion arise. For example, a simple constructed, compact device that employs a minimum amount of line is not infrequently needed by travelers in order to escape from the upper stories of buildings in case of fire or other emergency.

A further disadvantage of some prior escape devices is the substantial amount of heat build-up in the device during braking. This heat generation may be particularly harmful to nylon line whose use is otherwise attractive due to its low bulk for a given strength and ready availability. Undue heat may serve to bond or fuse the nylon fibers in the line which may materially lower the strength of the line and may even cause it to break during use which can be disastrous to a passenger or other load. Also, in some devices the line is subjected to considerable crushing force during braking or at other times. Undue crushing can also lead to loss of strength in the line.

The device of the present invention overcomes many, if not most, of the foregoing difficulties and provides a safe, easily-controlled device for a person or other load to move from an elevated location downwardly, or in an essentially horizontal direction at a lower level. The apparatus is compact, simple in construction, operated and controlled with ease at a substantial mechanical advantage, has low heat build-up, does not subject the operating line to undue crushing, and employs virtually the same amount of line as the distance to be travelled.

The device of the invention has at least one roller and preferably a plurality of rollers, mounted on a frame and designed so that the purposes and advantages of the invention can readily be accomplished. The rollers are generally tapered inwardly from at least one, and preferably from both, of their outer portions, and in the middle area of the roller a depression or groove is provided. A line, e.g. rope or cable, is threaded or run around one or more rollers, and due to the shape of the latter the line moves towards or remains in the grooved area as the device travels along the line.

When the operator desires to stop or control the travel of the device on the line, the rate of travel can be adjusted by exerting an appropriate holding force on the line below the location of the device. This force is considerably less than the weight of the load being lowered since the device has a substantial mechanical advantage that increases with the number of rollers provided in series with respect to line travel around the rollers. The holding force causes the line to grab or exert a frictional force against itself in its overlapped area in the groove around a given roller. The relative sizes of line and the width of the groove are suitable to provide this action while avoiding undue heat generation and line-crushing forces. This frictional or holding force can be such that travel of the device can readily be stopped or slowed as the operator desires. Yet upon reducing the holding force the frictional force is reduced even if the line be in a stationary and more or less locked position in the rollers. Thus, the operator which may, and often will, be the person escaping from the elevated location may readily control the descent of the load and do so with a significant mechanical advantage. A person need not be very strong to lower himself from the elevated location, yet the device does not employ substantially more line that that of a single strand running from a fixed upper position to the level or other location to which the load is to move.

The device of the invention can also be equipped with means for anchoring the upper end of the line which may be tightly secured to a suitable part of an upper location or furniture or other equipment therein. Also the device can carry at one end a suitable sling or other means for holding the load during the descent or horizontal movement.

Accordingly, the present invention provides an improved means of controlling the rate of descent of a passenger or other load in a fire escape device through the use of tapered and grooved rollers. The device can be used in both vertical and horizontal escape methods, with control being accomplished either by the passenger or an individual at the load destination or other location to which the lower end of the line may reach. The invention also provides a body belt which can be easily adjusted to safely secure passengers of various sizes.

Further objects, advantages, and features of the invention will be apparent in the arrangement and construction of the constituent parts in detail as set forth below taken together with the accompanying drawings in which FIG. 1 shows an apparatus of the invention;

FIG. 2 depicts the apparatus in use;

FIG. 3 illustrates a manner in which the upper end of the line of the device may be secured to a door;

FIG. 4 shows a frame member of the device equiped with three rollers;

FIG. 5 is a horizontal cross-sectional view of a suitable roller;

FIG. 6 depicts a way in which the body belt may be secured; and

FIG. 7 is a plan view of a buckle for the body belt of FIG. 6.

Referring to the drawings there is shown a preferred embodiment of this invention. The fire escape device includes a rope, cable or other flexible line 10 which is threaded around at least one roller 22, and preferably around each of two or more of a series of rollers 22. The rollers may be vertically-positioned from one another and are preferably mounted substantially parallel to each other in frame 24. The upper end of flexible line 10 is releasably attached to a secured object such as a door knob so as to provide support for the passenger during use of the device. For example, line 10 can be wrapped around door knobs 12 and 12' on opposite sides of door 14. The end of the line can be secured or locked around itself by a link connector 16 or other mechanical device attached to the terminus of line 10. This connector has a gap (not shown) in one side and the ends of the connector at each side of the gap may be threaded. The gap can be closed by a threaded coupling 18 to secure the free end of line 10 to itself as shown.

A flexible sleeve 20 can be employed over line 10 to protect the line from abrasion or undue wear if it be placed over an edge such as the sill of a window through which the passenger makes his escape. Sleeve 20 surrounds line 10 over a length suitable to protect the line between its attachment to a support and frame 24. Sleeve 20 can be slid into position to facilitate its use on the window sill or against another object.

Line 10 is passed serially around each of the rollers 22 mounted rotatably in frame 24 by the nut and bolt combination passing through the middle of the respective rollers and the adjacent legs of frame 24. Frame 24 functions as a housing for rotatable rollers 22 and may comprises two substantially parallel rectangular metal legs spaced, for example, about 2" apart. The legs of frame 24 are joined at one end by an intermediate segment of metal 28 which serves to space, support, and attach the legs of the frame. This configuration may be accomplished by bending a long, flat strip of metal into a V-shaped configuration to facilitate the positioning of rectangular connector 40 in the middle of the device. The two sides of the frame serve to support the plurality of rollers 22.

Each of the rollers 22 shown has inwardly-inclined or slanted sides 30 and these terminate at their inner ends in a groove 32 which passes around the roller. The device may be useful if only one of sides 30 is slanted inwardly, e.g., that on the side of which the overlap 50 is positioned, but the device may be more reliably operated if both sides are slanted inwardly as shown. The sides 31 and 33 of groove 32 may be more or less perpendicular to the axis of the roller or may be slanted outwardly at an angle to the horizontal that is substantially greater than that of tapered sides 30.

Preferably, however, side 31 of the groove is essentially perpendicular to the axis of roller 22 and the other side 33 is shaped to enhance the locking action of line 10 against itself, as well as rapid release. Thus, this second side 33 can be shaped so that the portion of line 10 that is positioned further away or outwardly from the bottom 37 of the groove 32 at the overlap 50 where line 10 is in frictional contact with itself, is subjected to a feeding action towards the portion of the line that is in the bottom of the groove as the device moves along the line. This action can be provided by the second side 33 of the groove being slanted outwardly, but preferably the second side of the groove is essentially perpendicular to the axis of the roller and has a rounded upper corner 35 for this purpose. The depth of groove 32 is preferably such that the outer portion of line 10 in the overlap 50 is in contact with rounded corner 35. Line 10 is positioned against side 31 of the groove where the line contacts the bottom 37 of groove 32. The depth of the groove may, for example, be of at least about one-half the diameter of the line, and generally may be up to about twice such diameter or more. Groove 32 has a width which is at least, or somewhat greater, than the diameter of line 10, and the width of grooves 32 may be up to less than twice the diameter of line 10, preferably not more than about 1.5 times the diameter of the line, to insure that the frictional locking action of the line against itself occurs. The width of groove 32 is not so great that the contacting entrance and exit portions of the loop of the line 10 in the groove around the roller are in a side-by-side position on the bottom 37 of groove 32. Thus, line 10 exerts friction against itself and such friction is the primary force for stopping or controlling descent of the device along line 10.

Coupled to bar 28 between the legs of frame 24 is a rectangular loop 40 of metal. It is through this loop that body belt 42 is attached to frame 24. Body belt 42 is a narrow (e.g., 2" wide) length of heavy textile webbing or other belting in which are embedded eyelets 44 which are spaced in holes along the midline of the belt.

The loop formed by the belt 42 distal to frame 24 can be increased or decreased in size by use of a buckle 46 to accommodate a variety of passenger sizes. Buckle 46 is a rectangular loop of metal which has opposed, internal projections 48 that are attached at the midpoints of the two long sides of the rectangle with the space between the free ends of the projections being sufficient to permit passage of eyelets 44. Buckle 46 is utilized by choosing the most appropriate eyelets and engaging them simultaneously in the buckle which holds the upper portions 47 of the legs of the belt 42 in a relatively closely-spaced relationship.

Referring again to FIGS. 1 and 5 there is demonstrated one embodiment for threading line 10 through the frame 24 and around each roller 22 in series. In this embodiment, the line which may, for example, have a diameter of 5/16" is wrapped around the complete circumference of each roller 22 in its groove 32 which may, for the example, have a width of ⅜" and a depth of 5/16". With respect to a given roller the line extends in generally opposite directions. The resulting line-to-line friction of contact of this threading arrangement forms the crossing areas or overlaps 50 in grooves 32 which allow a controlled descent of the passenger or other load without significant heat build-up in or undue crushing of line 10. As the passenger or other operator controls the amount of holding force on line below frame 24 the locking force of line 10 in areas 50 is controlled. Accordingly, as the operator reduces the holding force the locking force becomes less and the rate of descent of the passenger increases. As the holding on line 10 below frame 24 is increased the locking force in areas 50 increases and the descent rate decreases and may even be readily stopped. Yet this control is effected with relative ease due to the mechanical advantage of the device resulting from the passing of line 10 around rollers 22 of desired configuration.

While the specific embodiments of this invention have been shown and described, it will be apparent that modifications could be made without departing from the invention, and it is intended by the appended claims to cover all such modifications as come within the spirit and scope of the invention.

It is claimed:

1. A device suitable for use in lowering a load comprising a frame, a roller rotatably mounted on said frame, said roller having a groove positioned around said roller, the surface of said roller adjacent a side of said groove being inclined inwardly toward said groove, a flexible line forming a loop around said roller within said groove, said line extending in generally opposite directions from said roller, said groove having a width confining said line such that said line frictionally contacts itself at the entrance and exit portions of the loop in said groove, said frame and roller being movable along said line by application of a load on said frame, and the movement of said frame and roller being controllable by application of a force on said line.

2. A device of claim 1 wherein said roller has inwardly inclined surfaces on both sides of said groove.

3. A device of claim 1 or 2 having a plurality of said rollers and said line is positioned around said rollers in series in the grooves of said rollers.

4. A device suitable for use in lowering a load comprising a frame, a roller rotatably mounted on said frame, said roller having a groove positioned around said roller, the surface of said roller adjacent a side of said groove being inclined inwardly toward said groove, said groove having at least one side that is essentially perpendicular to the axis of its roller, a flexible line positioned in said groove around said roller, said line extending in generally opposite directions from said roller and thereby contacting itself in said groove and in frictional engagement with itself, said frame and roller being movable along said line by application of a load on said frame, and the movement of said frame and roller being controllable by application of a force on said line.

5. A device of claim 4 in which both sides of said groove are essentially perpendicular to the axis of its roller and one said side has a rounded upper corner.

6. A device of claim 1 or 2 having means for holding a load at one end of said frame.

7. A device of claim 1 or 2 wherein one end of said line has mechanical means for attaching the line to a support.

8. A device of claim 7 having means for holding a load at the end of said frame opposite to that from which the line having said mechanical means extends.

9. A device suitable for use in conjunction with a flexible line for lowering a load comprising a frame having opposed sides, a roller mounted rotatable between said sides, said roller having a groove extending therearound, said groove having a depth at least one-half the diamter of the line and having a width which is greater than the diameter of the line and which is less than twice the diameter of the line for confining a loop of the line in the groove, said roller having a surface adjacent a side of said groove, said surface being inclined inwardly toward said groove.

10. A device of claim 9 wherein said roller has inwardly inclined surfaces on both sides of said groove.

11. A device of claim 10 wherein a plurality of said rollers are rotatably mounted between said sides and the axis of said rollers are substantially parallel to one another.

12. A device of claim 11 wherein the sides of said groove are substantially perpendicular to the axis of its roller.

13. A device of claim 12 wherein one of said sides has a rounded upper corner.

14. A device of claim 9, 10, 11, 12 or 13 having a flexible line in said groove of a respective roller and encircling said roller, and when a plurality of said rollers are present said line encircles said rollers in series.

15. A device of claim 14 wherein means are provided for holding a load at one end of said frame.

16. A device of claim 15 wherein one end of said line has mechanical means for attaching said line to a support.

17. A device of claim 16 having means for holding a load at the end of said frame opposite to that from which the line having said mechanical means extends.

18. A device of claim 15 having a plurality of said rollers.

19. A device of claim 18 wherein said holding means comprises a belt having two legs extending from said frame, each leg having a series of perforations spaced along its length, and buckle means for holding said belt legs in a position closely-spaced to one another.

20. A device of claim 19 wherein said buckle means is rectangular and has internal projections on opposite sides of said buckle means for engagement with said perforations in said legs of said belt.

* * * * *